US008933873B2

(12) United States Patent
Gotoh

(10) Patent No.: US 8,933,873 B2
(45) Date of Patent: Jan. 13, 2015

(54) DISPLAY APPARATUS, DRIVE METHOD, AND RECORDING MEDIUM

(75) Inventor: Toshiyuki Gotoh, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 280 days.

(21) Appl. No.: 13/531,126

(22) Filed: Jun. 22, 2012

(65) Prior Publication Data

US 2012/0327134 A1 Dec. 27, 2012

(30) Foreign Application Priority Data

Jun. 23, 2011 (JP) ..... 2011-139839

(51) Int. Cl.
*G09G 3/36* (2006.01)
*G09G 3/34* (2006.01)

(52) U.S. Cl.
CPC ..... *G09G 3/3611* (2013.01); *G09G 3/3406* (2013.01); *G09G 2300/0452* (2013.01); *G09G 2320/0646* (2013.01); *G09G 2360/16* (2013.01)
USPC ..... 345/102; 345/88

(58) Field of Classification Search
CPC ..... G09G 3/36
USPC ..... 345/83, 88, 102, 204, 690
See application file for complete search history.

(56) References Cited

U.S. PATENT DOCUMENTS

| | | | | |
|---|---|---|---|---|
| 7,277,075 | B1 | 10/2007 | Hirano et al. | |
| 8,004,545 | B2 | 8/2011 | Inuzuka et al. | |
| 8,169,389 | B2 * | 5/2012 | Cok et al. | 345/83 |
| 8,330,689 | B2 * | 12/2012 | Morisue et al. | 345/88 |
| 8,681,190 | B2 * | 3/2014 | Yano et al. | 345/690 |
| 2007/0064162 | A1 | 3/2007 | Yamamoto et al. | |
| 2008/0180384 | A1 * | 7/2008 | Aoki et al. | 345/102 |
| 2010/0164919 | A1 | 7/2010 | Yamamoto et al. | |

FOREIGN PATENT DOCUMENTS

| | | | |
|---|---|---|---|
| CN | 101379426 | A | 3/2009 |
| JP | 2001-147666 | A | 5/2001 |
| JP | 2007-10753 | A | 1/2007 |
| JP | 2008-96548 | A | 4/2008 |
| JP | 2008-139809 | A | 6/2008 |

* cited by examiner

*Primary Examiner* — Pegeman Karimi
(74) *Attorney, Agent, or Firm* — Birch, Stewart, Kolasch & Birch, LLP

(57) ABSTRACT

In a display apparatus provided with a backlight which includes a plurality of color components and emits light of a color of white or other colors and with a liquid crystal display section, RGB values for identifying a color of light which passes through the liquid crystal display section assuming that the backlight emits white light are calculated, first RGB values representing a transmittance of the liquid crystal display section are calculated based on the RGB values, and the liquid crystal display section is driven based on the first RGB values.

3 Claims, 7 Drawing Sheets

DISPLAY APPARATUS, DRIVE METHOD, AND RECORDING MEDIUM

CROSS-REFERENCE TO RELATED APPLICATIONS

This non-provisional application claims priority under 35 U.S.C. §119(a) on Patent Application No. 2011-139839 filed in Japan on Jun. 23, 2011, the entire contents of which are hereby incorporated by reference.

BACKGROUND

1. Technical Field

The present invention relates to a display apparatus provided with a backlight including a plurality of color components and with a liquid crystal display section, a drive method concerning the display apparatus, and a recording medium in which a computer program is recorded.

2. Description of Related Art

In recent years, in order to improve a transmittance of a liquid crystal panel and to use a luminance of a backlight efficiently, a display apparatus is known in which a white (W) sub-pixel is added in addition to the conventional three primary colors of RGB.

For example, Japanese Patent Application Laid-Open No. 2001-147666 discloses an RGBW-type liquid crystal display apparatus in which a transparent filter (W) is provided in addition to RGB filters. In such a liquid crystal apparatus, a white component is added for improvement in luminance to a red component, a green component and a blue component of an inputted original image, respectively, and then proportions of the red component, the green component and the blue component obtained after the addition of the white component are converted to proportions of the red component, the green component and the blue component of the original image, and the respective RGBW sub-pixels are driven.

Moreover, Japanese Patent Application Laid-Open No. 2008-139809 discloses a transmission-type liquid crystal display apparatus provided with a liquid crystal panel in which one pixel is divided into four sub-pixels of red, green, blue and white and with a backlight which is capable of controlling a emission luminance, thereby an amount of light absorbed not only by the liquid crystal panel but by a color filter can be reduced, and further reduction of power consumption can be attained.

SUMMARY

On the other hand, since, in a display apparatus provided with a backlight including a plurality of color components (for example, RGB), each color component of the backlight is independently controlled according to an image to be displayed, in other words, according to a color of light to be displayed through a color filter of a liquid crystal panel, a color emitted by the backlight differs each time. Therefore, there is a problem that a color of light to be displayed cannot be displayed correctly in a display apparatus provided with a backlight including a plurality of color components and with a liquid crystal panel including a white sub-pixel.

In detail, for the white sub-pixel a transparent color filter is attached or a color filter is not attached, and light emitted from the backlight passes through the white sub-pixel. As a result, there is a problem that, in a case where the light which has passed the white sub-pixel has a predetermined color, a hue of light to be displayed on the liquid crystal panel may vary under the influence of the color.

However, since both of the above-described liquid crystal display apparatuses disclosed in Japanese Patent Application Laid-Open No. 2001-147666 and Japanese Patent Application Laid-Open No. 2008-139809 are based on the premise that the backlight emits white light, the above-described problems in the backlight including a plurality of color components cannot be resolved using the above-described liquid crystal display apparatuses.

The present invention has been made with the aim of solving the above problems, and it is an object of the invention to provide a display apparatus provided with a backlight which includes a plurality of color components and emits light of white or other colors and with a liquid crystal display section, in which first RGB values used for drive of the liquid crystal display section are calculated based on particular RGB values for identifying a color of light which passes through the liquid crystal display section on the assumption that the backlight emits white light, and the liquid-crystal display section is driven based on the first RGB values, thereby preventing a problem that a hue of light to be displayed on a liquid crystal panel may vary under the influence of a color of light which has passed through a white sub-pixel by a reason that light emitted from the backlight has passed through the white sub-pixel, a drive method and a recording medium in which a computer program is recorded.

The display apparatus according to the present invention is a display apparatus provided with a backlight which includes a plurality of color components and emits light of white or other colors, and with a liquid crystal display section, comprising: a calculation section for calculating first RGB values used for drive of the liquid crystal display section, based on particular RGB values for identifying a color of light which passes through the liquid crystal display section assuming that the backlight emits white light; and a liquid-crystal drive section for driving the liquid crystal display section based on the calculated first RGB values.

In the present invention, when the backlight emits light of a predetermined color, the calculation section calculates particular RGB values for identifying a color of light which passes through the liquid crystal display section on the assumption that the backlight emits white light, and calculates the first RGB values based on the particular RGB values. The liquid-crystal drive section drives the liquid crystal display section based on the first RGB values.

The display apparatus according to the present invention is characterized in that the liquid crystal display section includes RGBW sub-pixels, and the calculation section is provided with: an RGB calculation section for calculating second RGB values used for drive of the liquid crystal display section and third RGB values used for drive of the backlight based on gray level with a plurality of color components an image to be displayed; a particular-value calculation section for calculating the particular RGB values by adding a minimum value of the color components s of the image to be displayed to each of the color components; a multiplication section for multiplying a sub-pixel value for a W sub-pixel in the second RGB values by the third RGB values; and a subtraction section for subtracting a result of multiplication by the multiplication section from the particular RGB values calculated by the particular-value calculation section, and the calculation section divides a result of subtraction by the subtraction section by the third RGB values to calculate the first RGB values.

In the present invention, the RGB calculation section calculates second RGB values used for drive of the liquid crystal display section and third RGB values used for drive of the backlight based on gray level of an image to be displayed, and the particular-value calculation section adds a minimum value of the gray levels of the image to be displayed to each of the gray levels to calculate the particular RGB values. The multiplication section multiplies a sub-pixel value for a W sub-pixel in the second RGB values by the third RGB values, and the subtraction section subtracts a result of multiplication by the multiplication section from the particular RGB values calculated by the particular-value calculation section. A result obtained in this manner is divided by the third RGB values to calculate the first RGB values.

The drive method according to the present invention is a drive method in a display apparatus provided with a backlight which includes a plurality of color components and emits light of white or other colors, and with a liquid crystal display section which includes RGBW sub-pixels, the drive method for driving the liquid-crystal display section, comprising: a step of calculating first RGB values used for drive of the liquid crystal display section, based on particular RGB values for identifying a color of light which passes through the liquid crystal display section assuming that the backlight emits white light; and a step of driving the liquid crystal display section based on the calculated first RGB values.

The recording medium according to the present invention is a non-transitory computer-readable recording medium in which a computer program is recorded, the computer program causing a computer for controlling a backlight which includes a plurality of color components and emits light of white or other colors and controlling a liquid crystal display section which includes RGBW sub-pixels, to drive the liquid crystal display section, said computer program comprising: a step of causing the computer to calculate first RGB values used for drive of the liquid crystal display section, based on particular RGB values for identifying a color of light which passes through the liquid crystal display section assuming that the backlight emits white light; and a step of causing the computer to drive the liquid crystal display section based on the first RGB values.

In the present invention, when the backlight emits light of a predetermined color, particular RGB values for identifying a color of light which passes through the liquid crystal display section on the assumption that the backlight emits white light are calculated, the first RGB values are calculated based on the particular RGB values, and the liquid crystal display section is driven based on the first RGB values.

The drive method according to the present invention is characterized by further comprising: an RGB calculation step of calculating second RGB values used for drive of the liquid crystal display section and third RGB values used for drive of the backlight based on gray level with a plurality of color components an image to be displayed; a particular-value calculation step of adding a minimum value of the color components of the image to be displayed to each of the color components to calculate the particular RGB values; a multiplication step of multiplying a sub-pixel value for a W sub-pixel in the second RGB values by the third RGB values; a subtraction step of subtracting a result of multiplication at the multiplication step from the particular RGB values calculated at the particular-value calculation step; and a step of dividing a result of subtraction at the subtraction step by the third RGB values to calculate the first RGB values.

The recording medium according to the present invention is characterized in that the computer program further comprises: an RGB calculation step of causing the computer to calculate second RGB values used for drive of the liquid crystal display section and third RGB values used for drive of the backlight based on gray level with a plurality of color components an image to be displayed; a particular-value calculation step of causing the computer to add a minimum value of the color components of the image to be displayed, to each of the color components to calculate the particular RGB values; a multiplication step of causing the computer to multiply a sub-pixel value for a W sub-pixel in the second RGB values by the third RGB values; a subtraction step of causing the computer to subtract a result of multiplication at the multiplication step from the particular RGB values calculated at the particular-value calculation step; and a step of causing the computer to divide a result of subtraction at the subtraction step by the third RGB values to calculate the first RGB values.

In the present invention, second RGB values used for drive of the liquid crystal display section and third RGB values used for drive of the backlight are calculated based on gray levels with a plurality of color components an image to be displayed. A minimum value of the color components of the image to be displayed is added to each of the color components to calculate the particular RGB values. Moreover, a result obtained by subtracting, from the calculated particular RGB values, a result of multiplication of a sub-pixel value for a W sub-pixel in the second RGB values by the third RGB values is divided by the third RGB values, to calculate the first RGB values.

In the present invention, the above-described computer program is recorded in the recording medium. A computer reads the computer program from the recording medium, and the above-described display apparatus and drive method are realized by the computer.

According to the present invention, when the backlight which includes a plurality of color components and emits light of white or other colors emits light of a predetermined color which is not white, a problem that a hue of light to be displayed on the liquid crystal panel may vary under the influence of a color of light which has passed through a white sub-pixel by a reason that the light has passed through the white sub-pixel can be prevented.

The above and further objects and features will more fully be apparent from the following detailed description with accompanying drawings.

DETAILED DESCRIPTION (Embodiment 1)

The following description will explain a display apparatus, a drive method, and a computer program according to Embodiments of the present invention based on the drawings in detail.

Figure 1:
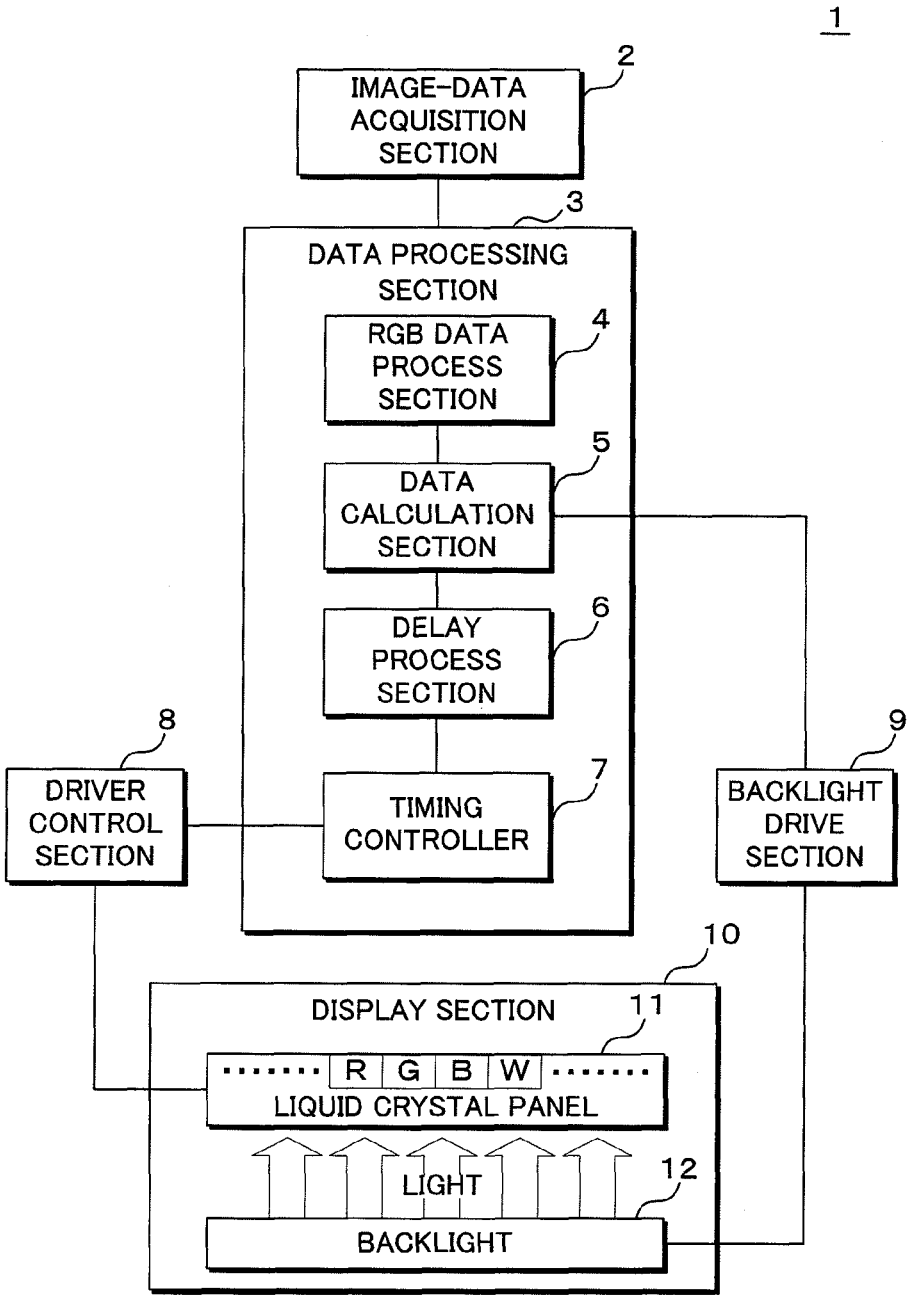
FIG. 1 is a functional block diagram showing an essential configuration of a display apparatus according to Embodiment 1 of the present invention.

FIG. 1 is a functional block diagram showing an essential configuration of a display apparatus 1 according to Embodiment 1 of the present invention. The display apparatus 1 comprises an image-data acquiring section 2, a data processing section 3, a display section 10, a driver control section 8, and a backlight drive section 9.

The image-data acquiring section 2 acquires data concerning an image to be displayed on the display section 10 (for example, RGB values) (hereinafter referred to as image data) from a storage section (not shown), for example. However, the image-data acquiring section 2 is not limited to this, and the image-data acquiring section 2 may be connected to a communication network, such as a public network, a LAN (Local Area Network) or the Internet via a network card or a modem etc. (not shown) so as to acquire predetermined image data from the outside. The image-data acquiring section 2 converts various inputted image data, and sends it to the data processing section 3.

The data processing section 3 is provided with an RGB-data process section 4, a data calculation section 5 (calculation section), a delay process section 6, and a timing controller 7 (liquid-crystal drive section).

The RGB-data process section 4 converts data whose input format is not an RGB format into RGB data, thereby data formats thereof are the same.

The data calculation section 5 performs various image adjustment processes of inputted data. In detail, the data calculation section 5 generates data for liquid crystal panel such as liquid-crystal-panel gray levels (first RGB values) used for display of a later-described liquid crystal panel 11, and data for backlight such as backlight gray levels (third RGB values) used for lighting of a later-described backlight 12. Moreover, the data calculation section 5 performs color correction (adjustment of luminance, saturation and hue), sharpness adjustment, modification of a gamma curve and a color temperature, etc. with respect to the data for liquid crystal panel. The generation of the liquid-crystal-panel gray levels and the backlight gray levels by the data calculation section 5 will be explained in detail later.

The data for backlight (backlight gray levels) generated by the data calculation section 5 is sent to the backlight drive section 9. The backlight drive section 9 lights the backlight 12 based on the data for backlight. That is, the backlight drive section 9 drives later-described LEDs of the backlight 12 respectively using the backlight gray levels in a controlled manner.

Also, the data for liquid crystal panel (liquid-crystal-panel gray levels) generated by the data calculation section 5 is sent to the delay process section 6. When the data for liquid crystal panel is inputted, the delay process section 6 delays the data for a predetermined time of period to conform an operation timing of the liquid crystal panel 11 to an operation timing of the backlight 12.

The timing controller 7 controls transmittances of sub-pixels of the liquid crystal panel 11 via the driver control section 8 based on the data for liquid crystal panel (liquid-crystal-panel gray levels) generated by the data calculation section 5.

The driver control section 8 controls a source driver (not shown) and a gate driver (not shown) which are connected to the liquid crystal panel 11 according to an instruction sent from the timing controller 7, drives the liquid crystal panel 11 for each sub-pixel, and causes the liquid crystal panel 11 to display a predetermined image.

The display section 10 is provided with an LCD panel, for example, and displays a predetermined image. Moreover, the display section 10 is further provided with the liquid crystal panel 11 and the backlight 12 for irradiating the liquid crystal panel 11 with light.

The liquid crystal panel 11 is provided with a pair of transparent substrates and with a liquid crystal layer and a color filter which are located between the transparent substrates. Moreover, a plurality of pixels composed of four kinds of a red (R) sub-pixel, a green (G) sub-pixel, a blue (B) sub-pixel and a white (W) sub-pixel are arranged in the liquid crystal panel 11, and the liquid crystal panel 11 displays a character(text), an image, etc. using light emitted from the backlight 12.

The R sub-pixel, the G sub-pixel and the B sub-pixel include a red color filter, a green color filter and a blue color filter, respectively. The W sub-pixel includes a transparent color filter or does not include a color filter.

The backlight 12 is provided with a group of optical sheets (not shown), with a diffuse plate, and with LED substrates in which light emitting diodes (LEDs) of three colors of red (R), green (G) and blue (B) are mounted, respectively. The LED substrates are located in a matrix form. The backlight 12 controls the LEDs respectively, and emits light of white or other colors.

As described above, in the display apparatus provided with the backlight including the plurality of color components and with the liquid crystal panel including the white sub-pixel, there is a problem that when a color of light emitted by the backlight is not white, the light emitted by the backlight passes through the white sub-pixel and a hue of light to be displayed on the liquid crystal panel may vary. The following description explains a case as an example in detail, in which gray levels (RGB values) of an image to be displayed are (1.0/0.8/0.25).

Note that (1.0/0.8/0.25) represents that R=1.0, G=0.8 and B=0.25 and represents proportions of gray levels (0-255) of respective color components (proportions of 255) in a case where gray levels (RGB values) are 8 bits.

Generally, a color of light which passes the liquid crystal panel can be identified by multiplication of a transmittance of the liquid crystal panel by a luminance of the backlight (LEDs). The transmittance of the liquid crystal panel and the luminance of the backlight are determined according to gray levels (RGB values) of image data to be displayed. Therefore, gray levels used for determination of a transmittance of the liquid crystal panel (liquid-crystal-panel gray levels), or gray levels used for determination of a luminance of the backlight (backlight gray levels) are changed, thereby a color of light which passes the liquid crystal panel can be changed.

Therefore, when RGB values of an image to be displayed are (1.0/0.8/0.25), the liquid-crystal-panel gray levels and the backlight gray levels are as follows, for example. Note that a maximum value MAX=1.0.

Liquid-crystal-panel gray levels: RGBW=1.0/1.0/0.5/0.5 (Process i)

Backlight gray levels: RGB=1.0/0.8/0.5 (Process ii)

Here, the liquid-crystal-panel gray levels are considered as linear data, and with respect to the liquid-crystal-panel gray levels, a minimum value of the gray levels (RGB values) is considered as a gray level for a W sub-pixel.

In this case, since the backlight emits light of not white but a predetermined color, a color of light which actually has passed the liquid crystal panel is influenced by a color of light of the backlight which has passed a white sub-pixel.

That is, a result obtained by adding a color component of light which has passed a W sub-pixel portion of the liquid crystal panel (hereinafter referred to as W color component) to a color component of light which has passed RGB sub-pixel portions of the liquid crystal panel (hereinafter referred to as RGB color component) becomes RGB values of a color of light which actually has passed the liquid crystal panel.

Here, RGB color components (R (r), G (g), B (b)) are as follows (Process iii).

R (r): 1.0×1.0=1.0

G (g): 1.0×0.8=0.8

B (b): 0.5×0.5=0.25

The W color components (W (r), W (g), W (b)) are determined by multiplication of the sub-pixel value for the W sub-pixel of the liquid-crystal-panel gray levels by backlight gray levels with respect to RGB respectively, and are as follows (Process iv).

W (r): 1.0×0.5=0.5

W (g): 0.8×0.5=0.4

W (b): 0.5×0.5=0.25

Therefore, when the values obtained at Process iv are added to the values obtained at Process iii (Process v), RGB values are as follows.

R: 1.0+0.5=1.5

G: 0.8+0.4=1.2

B: 0.25+0.25=0.5

In spite of RGB values of an image to be displayed being (1.0/ 0.8/0.25), the RGB values of the color of light which actually has passed the liquid crystal panel are (1.5/1.2/0.5). Even if the RGB values are normalized, RGB values become (1/0.8/0.33), thereby an image of a hue different from a hue of the image to be displayed is displayed.

Figure 2:
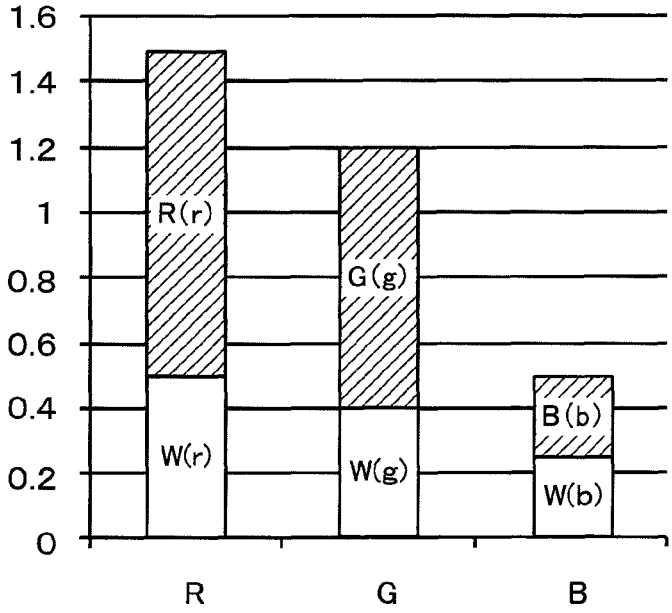
FIG. 2 is a graph showing proportions of RGB color components and W color components in an example of Embodiment 1 of the present invention.

FIG. 2 is a graph showing proportions of RGB color components and W color components in an example of Embodiment 1 of the present invention. In FIG. 2, hatching portions represent RGB color components. As shown in FIG. 2, when the backlight emits light of a predetermined color which is not white, an influence of a color of light of the backlight which has passed a white sub-pixel varies for each of RGB. As a result, it is understood that a color different from a color of an image to be displayed is displayed.

Note that the liquid-crystal-panel gray levels at Process i and the backlight gray levels at Process ii are not limited to the above-described ones. For example, the liquid-crystal-panel gray levels may be 'RGBW=1.0/1.0/1.0/1.0', and the backlight gray levels may be 'RGB=1.0/0.8/0.25'. Alternatively, the Liquid-crystal-panel gray levels may be 'RGBW=1.0/0.8/0.25/0.25', and the backlight gray levels may be 'RGB=1.0/1.0/1.0'. It is only necessary to obtain RGB values of an image to be displayed, by the multiplication of the liquid-crystal-panel gray levels by the backlight gray levels.

On the other hand, when the backlight emits white light, a color of light which passes a W sub-pixel is also white. Therefore, even if a W color component is added to each of RGB, a hue does not vary.

For example, when a W sub-pixel is '0.5', RGB values are (0.5 /0.5/0.5), and the backlight emits white light, W color components (W (r), W (g), W (b)) are (0.25, 0.25, 0.25). Therefore, when the W color components are added to RGB color components (Process vi), RGB values are as follows.

R: 1.0+0.25=1.25

G: 0.8+0.25=1.05

B: 0.25+0.25=0.5.

Figure 3:
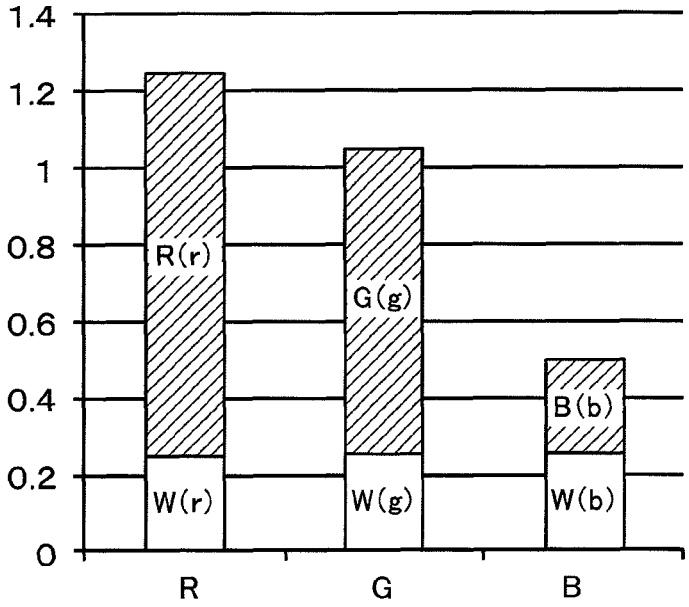
FIG. 3 is a graph showing proportions of RGB color components and W color components in a case where a backlight emits white light.

FIG. 3 is a graph showing proportions of RGB color components and W color components in a case where the backlight emits white light. That is, FIG. 3 represents a result of Process vi. In FIG. 3, hatching portions represent RGB color components. As shown in FIG. 3, it is understood that although a luminance of each of RGB is improved, a hue is maintained when the backlight emits white light.

In the present invention, based on such a fact, on the presumption that the backlight emits white light, liquid-crystal-panel gray levels are calculated according to a color of light emitted by the backlight, thereby preventing a problem that the hue may vary from occurring.

Figure 4:
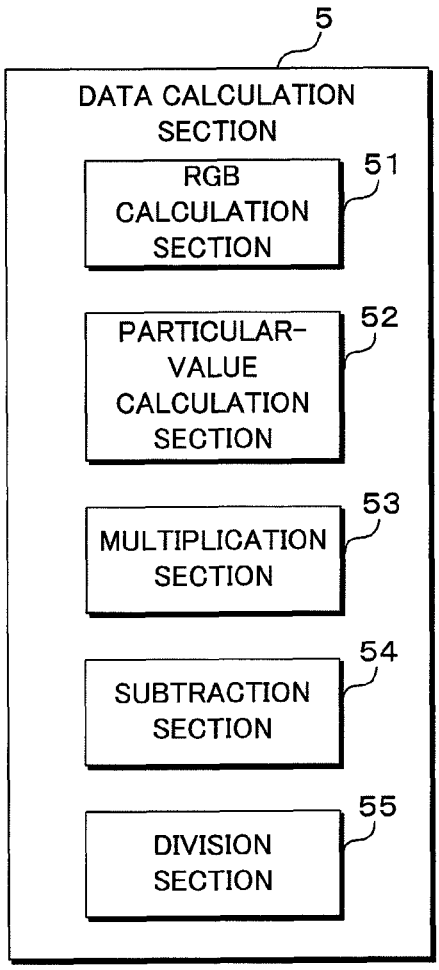
FIG. 4 is a functional block diagram showing an essential configuration of a data calculation section of the display apparatus according to Embodiment 1 of the present invention.

FIG. 4 is a functional block diagram showing an essential configuration of the data calculation section 5 of the display apparatus 1 according to Embodiment 1 of the present invention. The data calculation section 5 is provided with an RGB calculation section 51, a particular-value calculation section 52, a multiplication section 53, a subtraction section 54, and a division section 55. The following description explains a process of the data calculation section 5 in the display apparatus 1 according to the present invention with reference to FIGS. 2 to 4 in detail. Note that for convenience of the description, a case is explained as an example, in which RGB values of an image to be displayed are (1.0 /0.8/0.25) as is the case in the description of FIGS. 2 and 3.

The data calculation section 5 of the display apparatus 1 according to the present invention calculates liquid-crystal-panel gray levels (first RGB values) based on RGB values of an image to be displayed, so as to obtain a result identical to the result obtained when the backlight emits white light.

First, The RGB calculation section 51 calculates liquid-crystal-panel gray levels (second RGB values) and backlight gray levels (third RGB values) based on the RGB values of the image to be displayed which are inputted via the RGB-data process section 4, as is the case in the above-described Process i and Process ii.

Liquid-crystal-panel gray levels: RGBW=1.0/1.0/0.5/0.5 (Process vii)

Backlight gray levels: RGB=1.0/0.8/0.5 (Process viii)

The particular-value calculation section 52 adds a minimum value of the RGB values of the image to be displayed to each of the RGB values, thereby obtaining RGB values (particular RGB values) for identifying a color of light which passes through the liquid crystal panel 11 in a case where the backlight 12 emits white light. These RGB values become RGB values identical to the RGB values obtained at Process vi (Process ix).

RGB=1.25/1.05/0.5

The multiplication section 53 multiplies a sub-pixel value for a W sub-pixel of the liquid-crystal-panel gray levels obtained at Process vii by the backlight gray levels obtained at Process viii, as is the case in the above-described Process iv, thereby the W color components for each of RGB (Process x) are obtained.

W (r): 0.5, W(g): 0.4, W(b): 0.25

The subtraction section 54 subtracts the W color component obtained at Process x from each of the particular RGB values obtained at Process ix (Process xi). That is, RGB color components in the RGB values of light which passes through the liquid crystal panel 11 are obtained in a case where the backlight 12 emits white light.

R(r): 1.25−0.5=0.75

G(g): 1.05−0.4=0.65

B(b): 0.5−0.25=0.5

On the other hand, since RGB values of an image to be displayed are determined by the multiplication of the liquid-crystal-panel gray levels by the backlight gray levels as described above, when the backlight gray levels are values obtained at Process viii, corresponding liquid-crystal-panel gray levels can be obtained by dividing the RGB color components obtained at Process xi by the backlight gray levels.

The division section 55 divides the RGB color components obtained at Process xi by the backlight gray levels obtained at Process viii (Process xii).

Liquid-crystal-panel gray level: R=0.75/1.0=0.75

Liquid-crystal-panel gray level: G=0.65/0.8=0.8125

Liquid-crystal-panel gray level: B=0.25/0.5=0.5

Liquid-crystal-panel gray level: W=0.5 (minimum value)

The liquid-crystal-panel gray levels obtained by the RGB calculation section 51 at Process vii are replaced with the liquid-crystal-panel gray levels (first RGB values) obtained by the division of the division section 55 at Process xii.

Thereafter, the backlight drive section 9 lights the backlight 12 based on the backlight gray levels obtained by the RGB calculation section 51 at Process viii. The timing controller 7 controls the liquid crystal panel 11 based on the liquid-crystal-panel gray levels (first RGB values) obtained by the division of the division section 55 at Process xii, and causes the liquid crystal panel 11 to display a predetermined image. Thus, even if the backlight emits light of a predetermined color, improvement in a luminance of each of RGB can be achieved similarly to the case in which the backlight emits white light while a hue is maintained.

Here, RGB values of a color of light which has passed through the liquid crystal panel 11 are calculated based on the liquid-crystal-panel gray levels obtained at Process xii.

The liquid-crystal-panel gray levels obtained at Process xii are as follows.

RGBW=0.75/0.8125/0.5/0.5

The backlight gray levels obtained at Process viii are as follows.

RGB=1.0/0.8/0.5

When the calculations at Process iii, Process iv and Process v are performed using the liquid-crystal-panel gray levels and the backlight gray levels, as described above, RGB values of a color of light which has passed through the liquid crystal panel 11 become '1.25/1.05/0.5'. The RGB values are identical to the values obtained when the backlight 12 emits white light (see FIG. 3).

Figure 5:
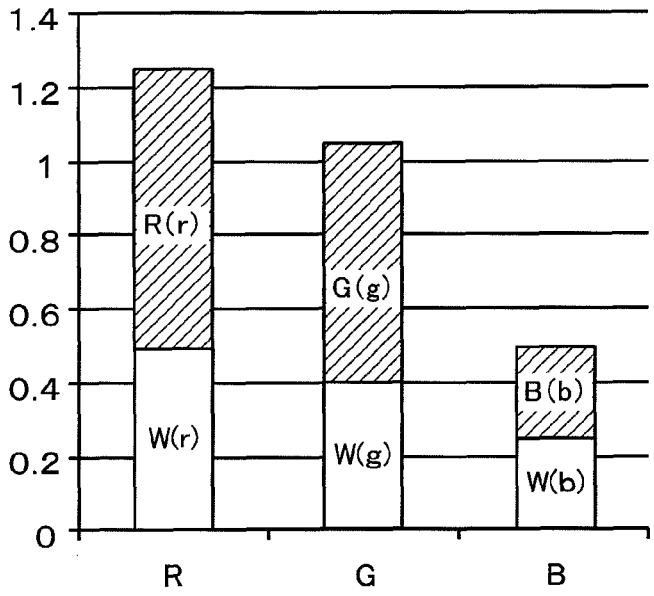
FIG. 5 is a graph showing proportions of RGB color components and W color components in display based on liquid-crystal-panel gray levels obtained by a data correction section of the display apparatus according to Embodiment 1 of the present invention.

FIG. 5 is a graph showing proportions of RGB color components and W color components in display based on liquid-crystal-panel gray levels obtained by the data correction section 5 of the display apparatus 1 according to the present invention. As shown in FIG. 5, the liquid crystal panel 11 is controlled based on the liquid-crystal-panel gray levels obtained at Process xii, thereby improvement in a luminance of each of RGB can be achieved while a hue is maintained, even if the backlight emits light of a predetermined color.

Figure 6:
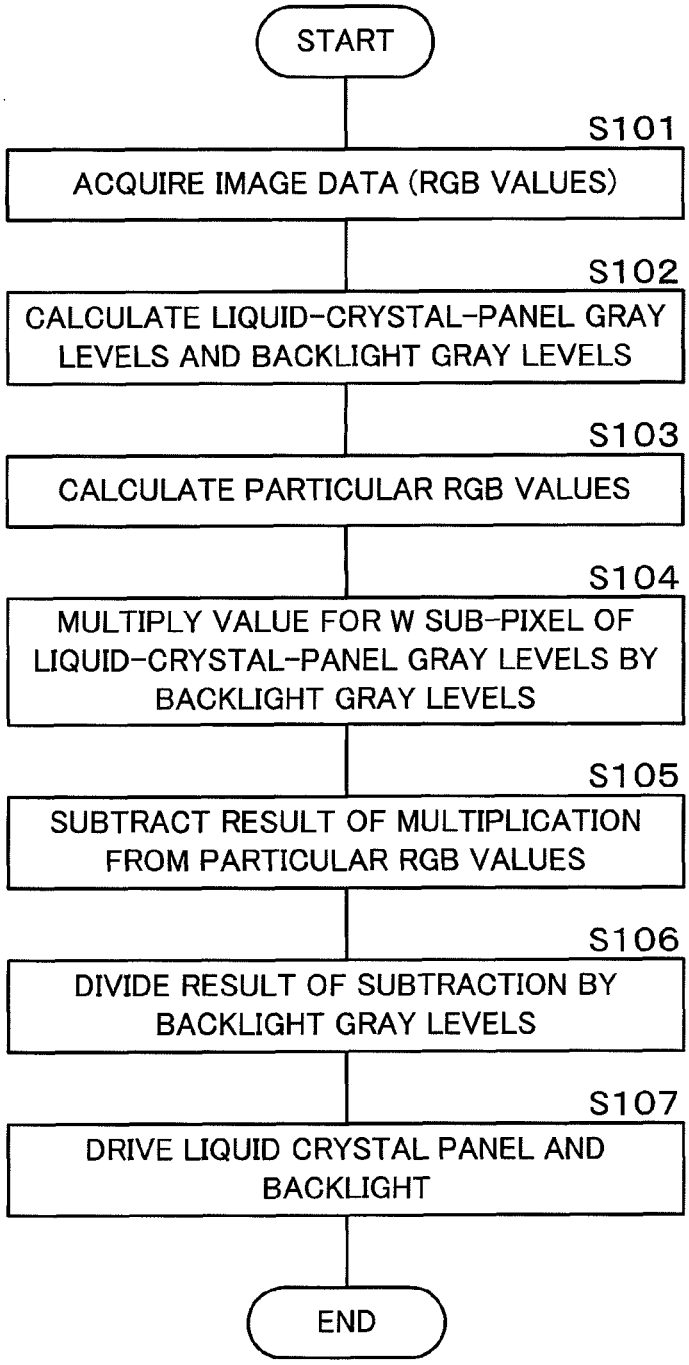
FIG. 6 is a flow chart explaining a process of generating liquid-crystal-panel gray levels in the display apparatus according to Embodiment 1 of the present invention.

FIG. 6 is a flow chart explaining a process of generating liquid-crystal-panel gray levels in the display apparatus 1 according to Embodiment 1 of the present invention.

First, the image-data acquiring section 2 acquires image data (RGB values) from the storage section, for example (Step S101). The image-data acquiring section 2 converts various inputted image data, and sends it to the data processing section 3.

In this case, the RGB calculation section 51 of the data calculation section 5 accepts RGB values of an image to be displayed via the RGB-data process section 4, and calculates liquid-crystal-panel gray levels and backlight gray levels based on the RGB values (Step S102) (see the above-described Process vii and Process viii).

The particular-value calculation section 52 adds a minimum value of the RGB values of the image to be displayed to each of the RGB values and calculate the particular RGB values (Step S103) (see the above-described Process ix).

Subsequently, the multiplication section 53 multiplies a sub-pixel value for a W sub-pixel of the liquid-crystal-panel gray levels obtained at Step S102 by the backlight gray levels (Step S104), to obtain the W color components (see the above-described Process x).

Then, the subtraction section 54 subtracts the W color components obtained at Step S104 from the particular RGB values obtained at Step S103, respectively (Step S105) (see the above-described Process xi).

Subsequently, the division section 55 divides the RGB values obtained by subtraction at Step S105 by the backlight gray levels obtained at Step S102 (Step S 106), to newly obtain liquid-crystal-panel gray levels (first RGB values) (see the above-described Process xii).

Thereafter, the liquid-crystal-panel gray levels obtained at Step S102 are replaced with the liquid-crystal-panel gray levels obtained at Step S106, the backlight drive section 9 lights the backlight 12 based on the backlight gray levels obtained at Step S102, and the timing controller 7 controls the liquid crystal panel 11 based on the liquid-crystal-panel gray levels newly obtained at Step S106 (Step S107).

(Embodiment 2)

Figure 7:
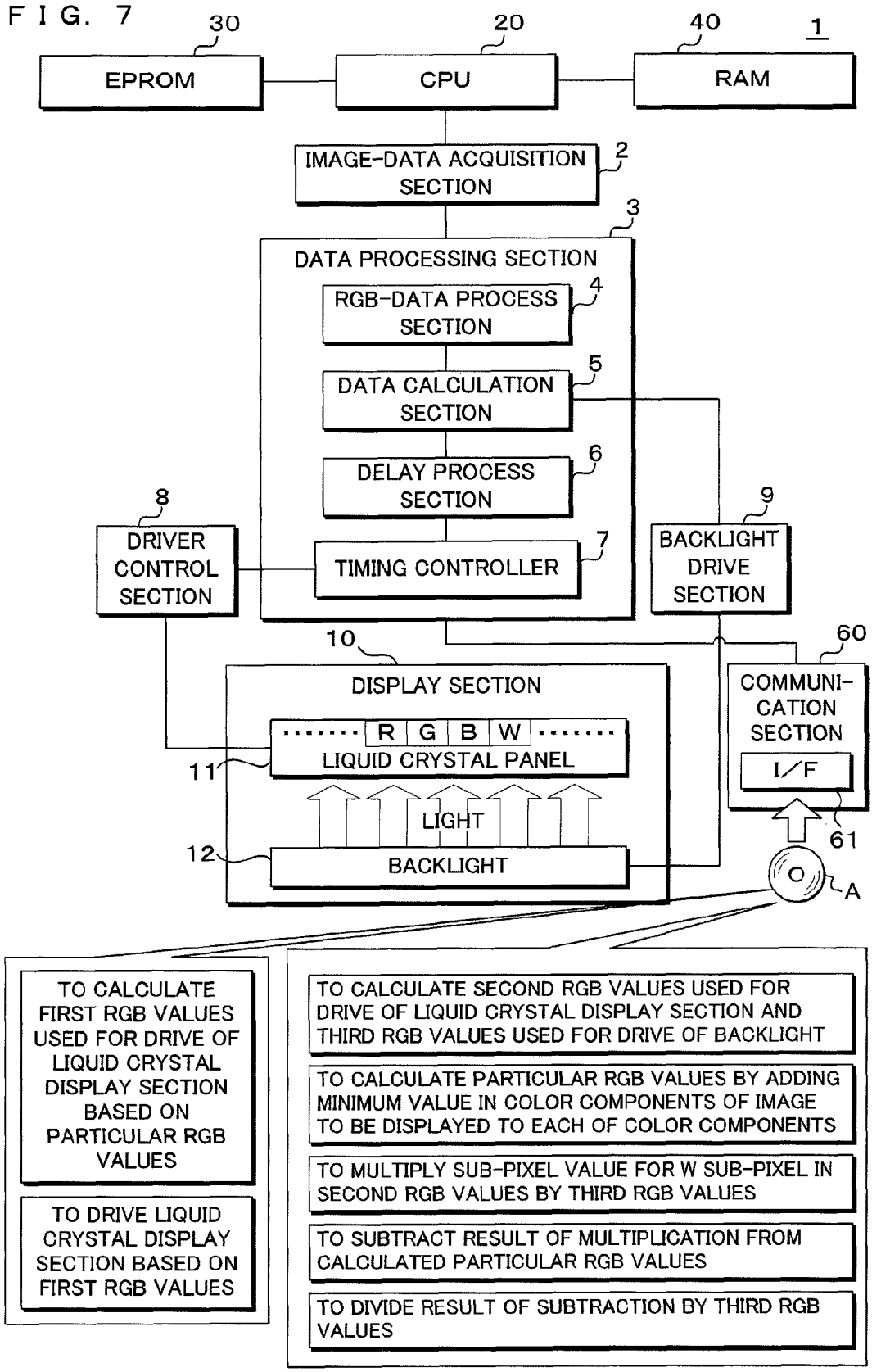
FIG. 7 is a functional block diagram showing an essential configuration of a display apparatus according to Embodiment 2 of the present invention.

FIG. 7 is a functional block diagram showing an essential configuration of the display apparatus 1 according to Embodiment 2 of the present invention. The display apparatus 1 according to Embodiment 2 is configured so that a computer program for operation is capable of being provided by a removable recording medium A, such as a CD-ROM, through an I/F 61. Moreover, the display apparatus 1 according to Embodiment 2 is configured so that the computer program is capable of being downloaded from an external device (not shown) through a communication section 60. The contents will be explained below.

The display apparatus 1 according to Embodiment 2 comprises an external (or internal) recording medium reader (not shown). A removable recording medium A, which records a program for: calculating first RGB values used for drive of a liquid crystal display section based on particular RGB values and driving the liquid crystal display section based on the first RGB values, and a program for: calculating second RGB values used for drive of the liquid crystal display section and third RGB values used for drive of the backlight based on the first RGB values; calculating particular RGB values by adding a minimum value of gray levels of an image to be displayed to each of the gray levels; multiplying a sub-pixel value for a W sub-pixel in the second RGB values by the third RGB values; subtracting a result of multiplication from the calculated particular RGB values; and dividing a result of subtraction by the third RGB values, is inserted into the recording medium reader device, and for example, the CPU 20 installs the program in an EPROM 30. The program is loaded in a RAM 40 and executed. Consequently, it functions as the display apparatus 1 according to Embodiment 1 of the present invention.

The recording medium may be a so-called program media, or a medium carrying program codes in a fixed manner, such as tapes including a magnetic tape and a cassette tape, disks including magnetic disks such as a flexible disk and a hard disk, and optical disks such as a CD-ROM, an MO, an MD, and a DVD, cards such as an IC card (including a memory card) and an optical card, or semiconductor memory such as a mask ROM, an EPROM, and an EEPROM, and a flask ROM.

Alternatively, the recording medium may be a medium carrying program codes in flowing manner like downloading the program codes from a network through the communication section 60. In a case where the program is downloaded from a communication network in such a manner, a program for downloading is stored in the main apparatus in advance, or is installed from a different recording medium. Note that the present invention is also implemented in the form of a computer data signal embedded in a carrier wave in which the program codes are embodied by an electronic transfer.

The same parts as in Embodiment 1 are designated with the same reference numbers, and detailed explanations thereof will be omitted.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

What is claimed is:

1. A display apparatus provided with a backlight which includes a plurality of color components and emits light of white or other colors, and with a liquid crystal display section, comprising:

a calculation section for calculating first RGB values used for drive of the liquid crystal display section, based on particular RGB values for identifying a color of light which passes through the liquid crystal display section assuming that the backlight emits white light; and a liquid-crystal drive section for driving the liquid crystal display section based on the calculated first RGB values, wherein the liquid crystal display section includes RGBW sub-pixels, and the calculation section is provided with:

an RGB calculation section for calculating second RGB values used for drive of the liquid crystal display section and third RGB values used for drive of the backlight based on gray level with a plurality of color components of an image to be displayed;

a particular-value calculation section for calculating the particular RGB values by adding a minimum value of the color components of the image to be displayed to each of the color components;

a multiplication section for multiplying a sub-pixel value for a W sub-pixel in the second RGB values by the third RGB values; and a subtraction section for subtracting a result of multiplication by the multiplication section from the particular RGB values calculated by the particular-value calculation section, and the calculation section divides a result of subtraction by the subtraction section by the third RGB values to calculate the first RGB values.

2. A drive method in a display apparatus provided with a backlight which includes a plurality of color components and emits light of white or other colors, and with a liquid crystal display section which includes RGBW sub-pixels, the drive method for driving the liquid-crystal display section, comprising:

a calculation step of calculating first RGB values used for drive of the liquid crystal display section, based on particular RGB values for identifying a color of light which passes through the liquid crystal display section assuming that the backlight emits white light; and a step of driving the liquid crystal display section based on the calculated first RGB values, wherein the calculation step comprises:

an RGB calculation step of calculating second RGB values used for drive of the liquid crystal display section and third RGB values used for drive of the backlight based on gray level with a plurality of color components of an image to be displayed;

a particular-value calculation step of calculating the particular RGB values by adding a minimum value of the color components of the image to be displayed to each of the color components;

a multiplication step of multiplying a sub-pixel value for a W sub-pixel in the second RGB values by the third RGB values;

a subtraction step of subtracting a result of multiplication at the multiplication step from the particular RGB values calculated at the particular-value calculation step; and a step of dividing a result of subtraction at the subtraction step by the third RGB values to calculate the first RGB values.

3. A non-transitory computer-readable recording medium in which a computer program is recorded, the computer program causing a computer for controlling a backlight which includes a plurality of color components and emits light of white or other colors and controlling a liquid crystal display section which includes RGBW sub-pixels, to drive the liquid crystal display section, said computer program comprising:

a calculation step of causing the computer to calculate first RGB values used for drive of the liquid crystal display section, based on particular RGB values for identifying a color of light which passes through the liquid crystal display section assuming that the backlight emits white light; and a step of causing the computer to drive the liquid crystal display section based on the first RGB values, wherein the calculation step comprises:

an RGB calculation step of causing the computer to calculate second RGB values used for drive of the liquid crystal display section and third RGB values used for drive of the backlight based on gray level with a plurality of color components of an image to be displayed;

a particular-value calculation step of causing the computer to calculate the particular RGB values by adding a minimum value of the color components of the image to be displayed to each of the color components;

a multiplication step of causing the computer to multiply a sub-pixel value for a W sub-pixel in the second RGB values by the third RGB values;

a subtraction step of causing the computer to subtract a result of multiplication at the multiplication step from the particular RGB values calculated at the particular-value calculation step; and a step of causing the computer to divide a result of subtraction at the subtraction step by the third RGB values to calculate the first RGB values.

* * * * *